US007533776B2

(12) United States Patent
Nickerson

(10) Patent No.: US 7,533,776 B2
(45) Date of Patent: May 19, 2009

(54) ORGANIZER/STORAGE RACK

(76) Inventor: Curtis M. Nickerson, 3042 32nd Ave. West, Seattle, WA (US) 98199

( * ) Notice: Subject to any disclaimer, the term of this patent is extended or adjusted under 35 U.S.C. 154(b) by 0 days.

(21) Appl. No.: 12/079,038

(22) Filed: Mar. 24, 2008

(65) Prior Publication Data

US 2008/0173604 A1 Jul. 24, 2008

Related U.S. Application Data

(62) Division of application No. 11/139,212, filed on May 27, 2005, now Pat. No. 7,360,661.

(51) Int. Cl.
*A47F 5/08* (2006.01)

(52) U.S. Cl. ..... 211/94.01; 211/74; 211/85.18

(58) Field of Classification Search ..... 211/94.01, 211/189, 49.1, 10, 74, 85.18, 85.29, 87.01, 211/126.1, 89.01; 312/35, 42, 45, 60, 72
See application file for complete search history.

(56) References Cited

U.S. PATENT DOCUMENTS 3,788,487 A * 1/1974 Dawson ..... 211/49.1
D233,120 S * 10/1974 Dawson ..... D7/701
4,003,612 A * 1/1977 Munsell ..... 312/245
4,026,449 A * 5/1977 Kevin ..... 294/161
4,083,482 A * 4/1978 Strenczewilk ..... 294/145
4,243,145 A * 1/1981 Woodhead ..... 211/59.2
4,305,512 A * 12/1981 Mackenzie ..... 211/75
4,611,718 A * 9/1986 Cohn et al. ..... 211/49.1
4,646,918 A * 3/1987 Liberti ..... 206/499
4,848,846 A * 7/1989 Yamada et al. ..... 30/276
4,889,245 A * 12/1989 Rinke ..... 211/49.1
4,944,924 A * 7/1990 Mawhirt et al. ..... 422/104
4,961,505 A * 10/1990 Moeller ..... 211/70.8
5,031,573 A * 7/1991 De Marco et al. ..... 119/496
5,244,272 A * 9/1993 Thompson ..... 312/334.23
5,400,736 A * 3/1995 Gold ..... 116/26
5,429,252 A * 7/1995 Liu ..... 211/94.01
5,460,160 A * 10/1995 Parrott ..... 126/263.01
5,603,401 A * 2/1997 Brunner ..... 206/204
5,615,780 A * 4/1997 Nimetz et al. ..... 211/49.1
5,655,673 A * 8/1997 Weterrings et al. ..... 211/75
5,678,348 A * 10/1997 Zielinski et al. ..... 43/26
6,267,415 B1 * 7/2001 Frank ..... 285/255
6,755,310 B1 * 6/2004 Hilton et al. ..... 211/59.2
2004/0020883 A1 * 2/2004 Brokaw ..... 211/89.01
2006/0196840 A1 * 9/2006 Jay et al. ..... 211/59.2

* cited by examiner

*Primary Examiner*—Jennifer E. Novosad
(74) *Attorney, Agent, or Firm*—Delbert J. Barnard

(57) ABSTRACT

A plurality of containers (32) are pitiable into tubular shelves (22). The containers (32) are cylindrical in shape and are sized so that they can be pushed sideways into a slot-like opening (26) in the tubular shelf (22). The containers (32) cam open the slot opening (26) both when they are pushed into the tubular shelves (22) and pulled out from the tubular shelves (22). End portions of the tubular shelves (22) fit within sockets (24) formed in, or on axles formed on, the side walls (16, 18) of a storage rack (10).

4 Claims, 9 Drawing Sheets

12
20
10
22
22
16
22
22
22
22
22
18
34
33
14
32
34
34
33
34
33
32
34
32
34

ORGANIZER/STORAGE RACK

RELATED APPLICATION

This application is a division of U.S. Ser. No. 11/139,212, filed May 27, 2005 now U.S. Pat. No. 7,360,661, and entitled ORGANIZER AND STORAGE RACK.

TECHNICAL FIELD

This invention relates to storage racks for small containers for storing, for example, various small items like bolts, nuts, screws, etc., drill bits, or other articles that can be found in a workshop; buttons, spools of thread, and other small articles that can be found in a sewing room; fish hooks, weights, and other items used by fishermen, or paper clips, staples and other small objects that are used in an office.

BACKGROUND OF THE INVENTION

Examples of prior art storage racks for small jars or containers are disclosed by U.S. Pat. No. 4,305,512 granted Dec. 15, 1981, to James F. Mackenzie, and by U.S. Pat. No. 5,615,780 granted Apr. 1, 1997 to Steven A. Nimetz and Caroline H. Nimetz. The storage rack disclosed by U.S. Pat No. 4,305,512 utilizes a vertical orientation of storage tubes and both wide and narrow slots in the fronts of the tubes. Cans or jars are inserted vertically into the storage tubes and are moveable out from the storage tubes through one of the wide slots. The storage rack disclosed by U.S. Pat. No. 5,615,780 comprises an elastic body member formed to include cavities into which jars or cans to be stored are inserted and removed. The cavities are vertical and the containers are inserted downwardly into the upper ends of the cavities. The resilient nature of the material forming the cavities allows the containers to be pulled out through slots at the fronts of the cavities.

U.S. Pat. Nos. 4,305,512 and 5,615,780 each suggest that its storage rack be used for receiving bottles or cans of baby food.

There is a need for a simple, easy-to-use storage rack that does not require either endwise movement of the objects to be stored in order to align them with a wide removal slot, or require a body made from an elastic material. A principal object of the present invention is to provide a storage rack constructed from readily available materials that is adapted to permit easy and quick removal of objects to be stored straight out from the front of the rack.

BRIEF SUMMARY OF THE INVENTION

The storage system of the present invention is basically characterized by an elongated tubular member having opposite ends and a side wall that includes a longitudinal slot that extends from one of said ends to the other. The tubular member has an inside diameter that is larger than the outside diameter of an object to be stored. The slot has throughout its length a width that is narrower than the diameter of the object to be stored. The tubular member is sufficiently resilient that a said object can be moved sideways against the slot and it will widen the slot a sufficient amount to allow the object to move through the slot, either into or out from the tubular member. The tubular member has a generally C-shaped cross-section throughout its length.

A first embodiment of the invention includes a mounting member and a plurality of the elongated tubular members that are mounted in parallelism on the mounting member. The mounting member includes sockets or axles which engage the opposite ends of the elongated tubular members. These elements hold the ends of the tubular members while at the same time allow the tubular members to expand when a said object is moved sideways through its slot, either into out from the tubular member. In preferred form, the mounting member has side parts and annular sockets are formed in the side parts, providing axles which extend into the ends of the tubular shelves.

The storage system may be adapted to hold a plurality of containers of a predetermined length and diameter which are positioned end-to-end in the tubular member.

In preferred form, the containers comprise transparent body portions and end caps that are frictionally retained on opposite ends of the body portion. The end caps have an outside diameter that is smaller than the inside diameter of the tubular member and is larger than the width of the slot.

The elongated tubular members are preferably made from plastic and each has a generally C-shaped cross-section throughout its length.

A second embodiment of the invention includes sidewalls provided with short axles which extend into the ends of the tubular shelves. In a third embodiment, the tubular shelves are stacked on each other and on a bottom wall and are received within the rear wall and a pair of trim strips that are secured to the sidewalls immediately forwardly of the tubular shelves. Each shelf has a space in which it is trapped. At the same time, it is free to spread apart when the containers are moved through the slot, either into or out from the storage tube.

In another embodiment, the storage tubes are secured to a back wall which may include shallow side frame members positioned endwise of the tubes to prevent the containers from sliding endwise out from the ends of the tubes. Or, the tubes may be provided with other types of stops at their ends for preventing movement of the containers endwise out from the tubes.

Other objects, advantages and features of the invention will become apparent from the description of the best mode set forth below, from the drawings, from the claims and from the principals that are embodied in the specific structures that are illustrated and described.

BRIEF DESCRIPTION OF THE SEVERAL VIEWS OF THE DRAWING

Like reference numerals are used to designate like parts throughout the several views of the drawing, and.

BEST MODE OF THE INVENTION

Figure 1:
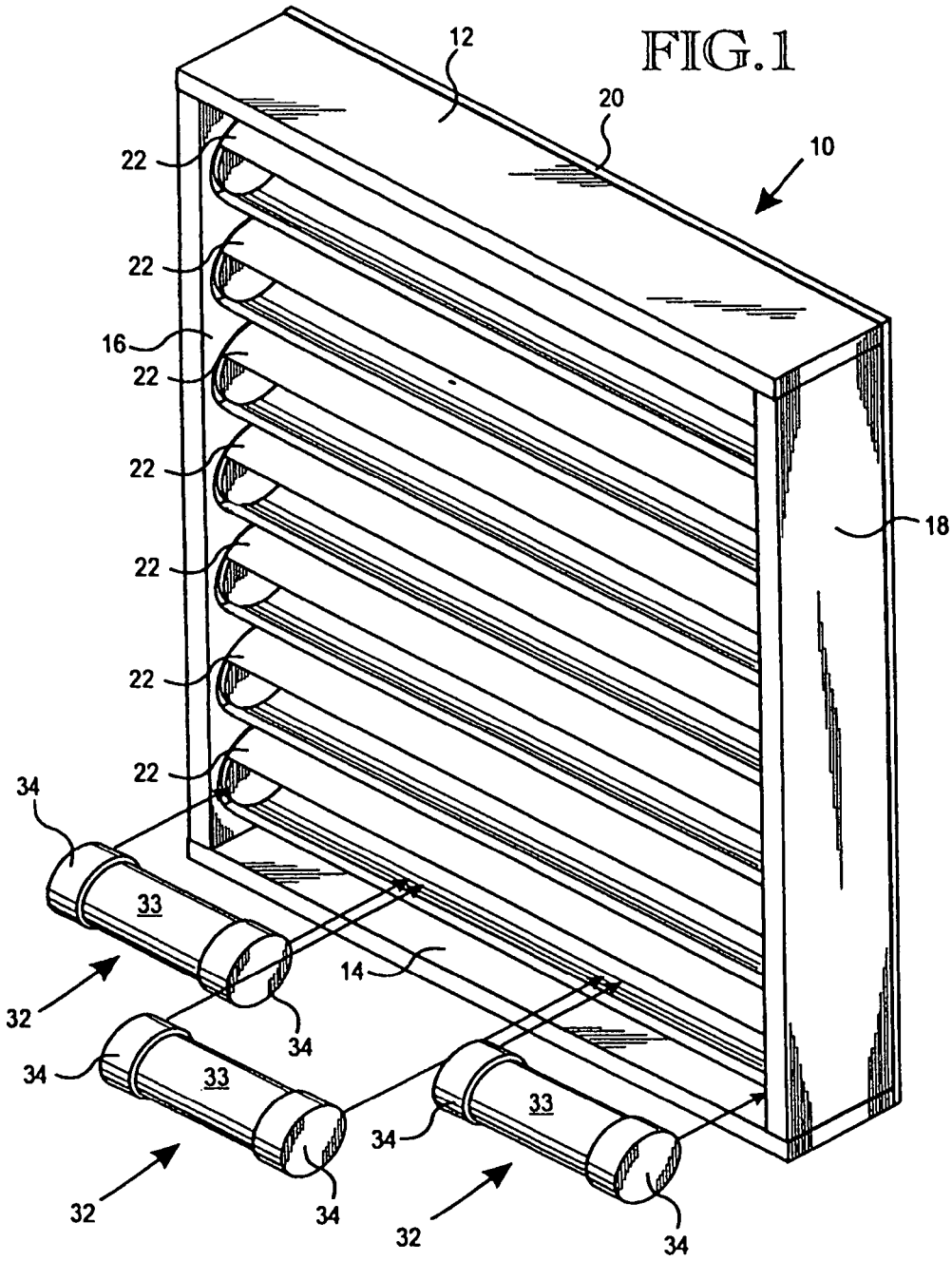
FIG. 1 is a pictorial view taken from above and looking towards the top, the front and one side of a storage system typifying the present invention, such view showing containers for small objects being spaced outwardly from a tubular shelf that is adapted to receive the containers and their contents.
Figure 2:
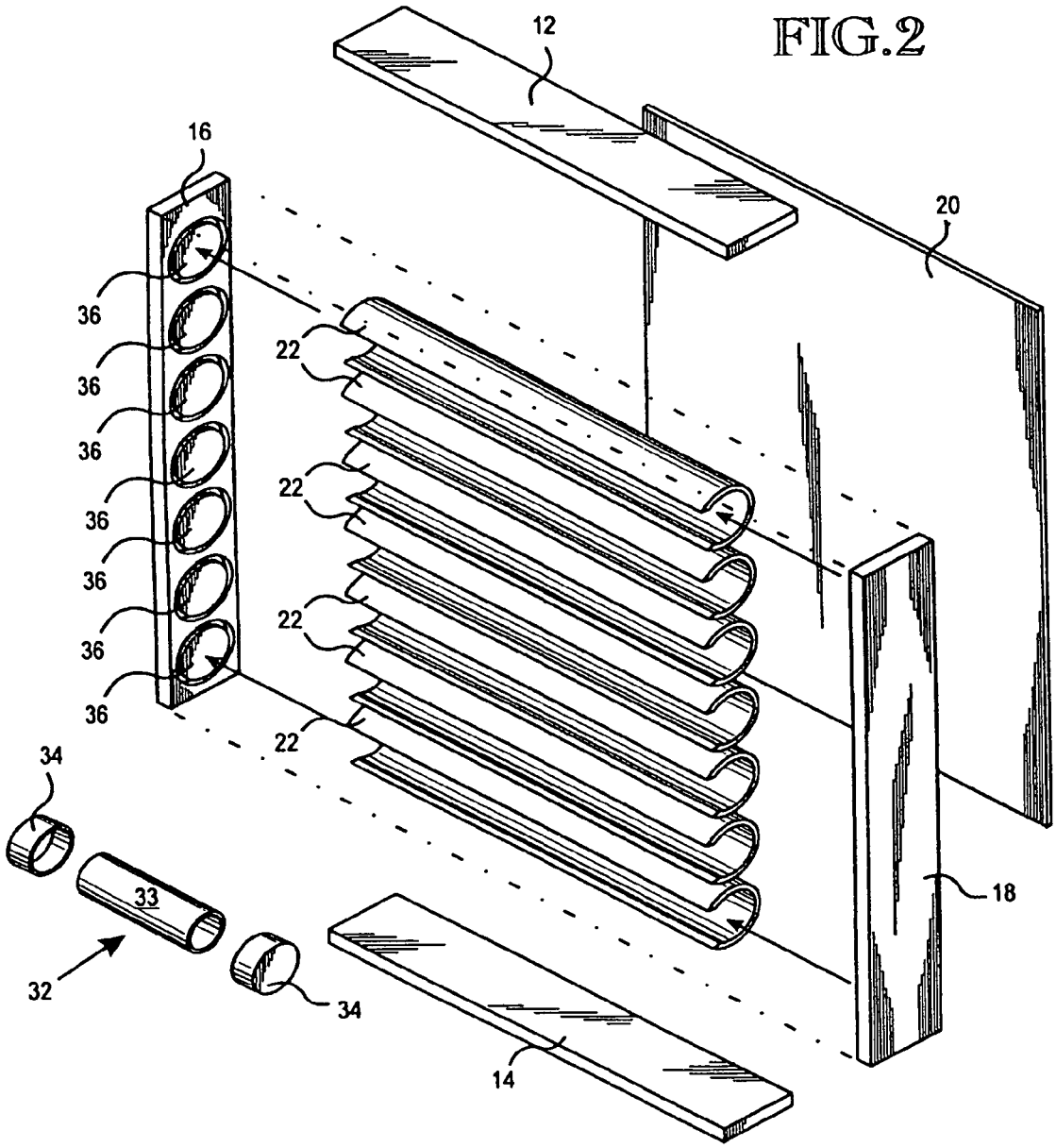
FIG. 2 is an exploded pictorial view taken from the same vantage point as FIG. 1.

FIGS. 1 and 2 show a storage rack 10 comprising a top 12, a bottom 14, a first side 16, a second side 18 and a back 20. When these parts are assembled, the top and bottom 12, 14 are parallel and are spaced vertically apart. The sides 16, 18 are parallel and are spaced horizontally apart. Top and bottom 12, 14 are perpendicular to the sides 16. The back 20 is secured at its periphery to the rear edges of top 12, bottom 14, and sides 16, 18 in any suitable manner. For example, the top 12 and bottom 14 may be secured to the ends of the sidewalls 16, 18 by screws or glue and the rear wall 20 may be secured to the rear edges of the top and bottom walls 12, 14 and the sidewalls 16, 18, also by either screws or glue. All of the walls 12, 14, 16, 18, 20 may be made in one piece, e.g. molded in one piece from a suitable structural plastic. Or, some of the walls could be molded together and the remaining wall or walls attached thereto to complete the rack.

Figure 3:
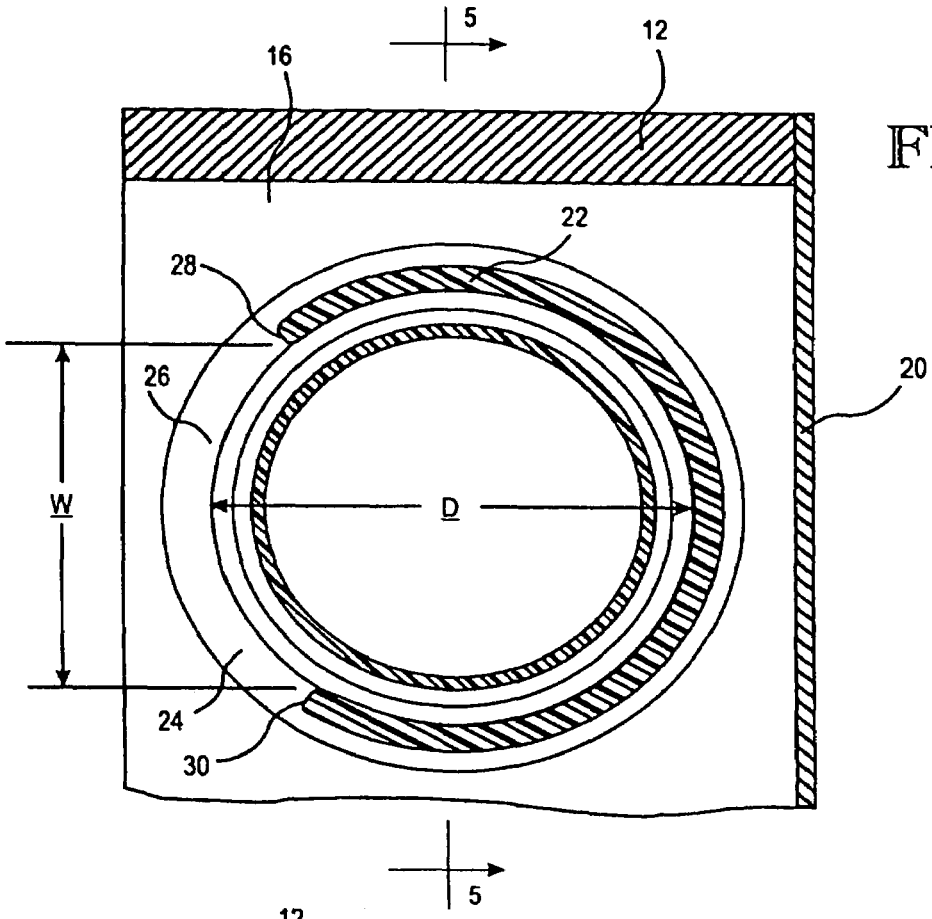
FIG. 3 is an enlarged scale fragmentary view of the upper portion of the cabinet shown in FIGS. 1 and 2, presenting the upper tubular shelf and an empty container in cross-section, such view showing the opening in the tubular shelf directed forwardly.
Figure 5:
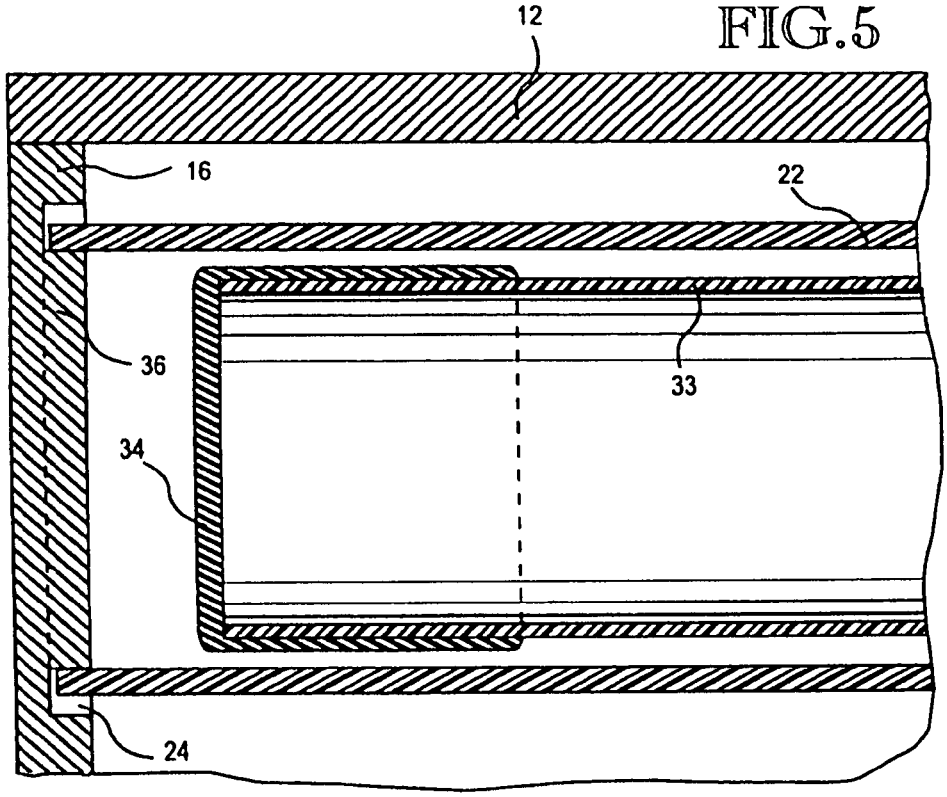
FIG. 5 is a fragmentary longitudinal sectional view through the tubular shelf, one of the containers and the side wall of the rack, such view showing the end of the tubular shelf positioned within an annular socket.

Sides 16, 18 are preferably formed to include sockets shown in the form of annular grooves, into which the ends of tubular shelves 22 extend. FIG. 3 shows one end of tubular shelf 22 within an annular groove 24. The inside diameter of the groove 24 is substantially the same as the inside diameter of the tubular shelf 22. The groove 24 has an outside diameter that is larger than the outside diameter of tubular shelf 22 (FIG. 5). Each tubular shelf 22 is a major portion of a tube from which a minor portion has been removed so as to form a side opening 26 in the form of a slot. Side opening or slot 26 has an upper edge 28, a lower edge 30, and a static width W that is smaller than the diameter D of containers 32 measured in the regions of their end caps 34. The central body portion 33 of each container 32 is preferably a clear plastic tube in the form of a right cylinder. The end caps 34 each has a circumferential wall and a radial end wall. They are snap fit onto the ends of the central tube 33. They may be made from a softer plastic material than the central tube. The caps 34 are frictionally retained on the ends of the central tube 33 but can be removed by applying a relatively small pulling force on the cap 34. The end caps 34 may be a colored plastic. The containers 32 are per se old. However, they are especially adapted for use with the tubular shelves 22 which are new and the combination in new.

Figure 6:
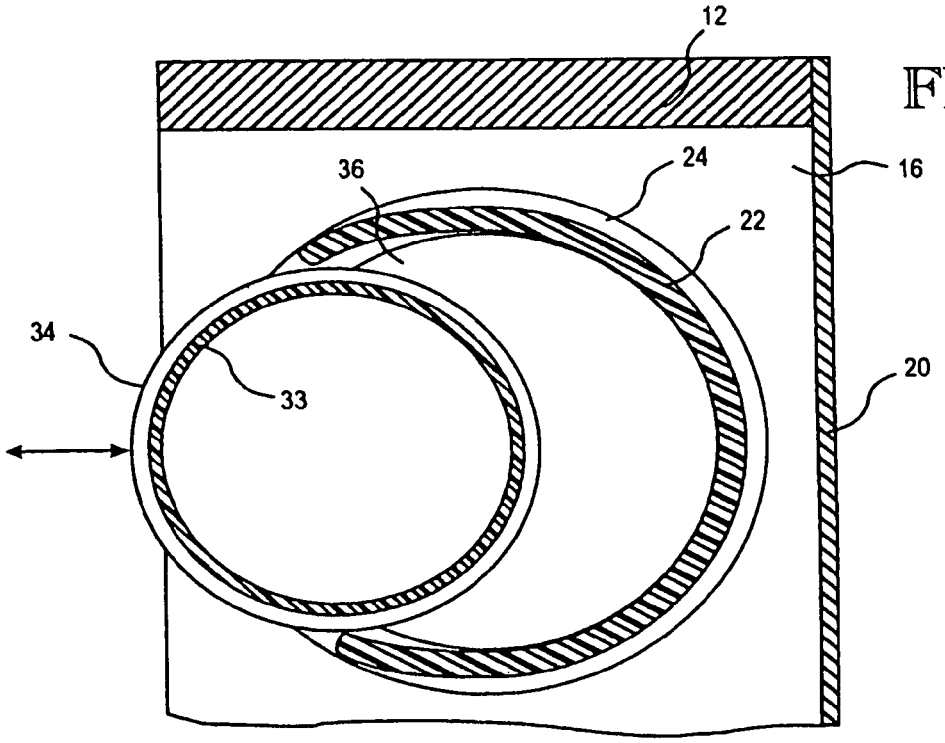
FIG. 6 is a view like FIG. 3, showing the container moving either inwardly or outwardly through the opening and in the process spreading the tubular shelf in order to enlarge the opening to allow the passage of the container.

The containers 32 can be grasped and pulled out from the tubular shelves 22 through the openings 26. As the container 32 moves outwardly, the curved surfaces at the forward portions of the caps 34 exert a camming force on the edges 28, 30, spreading them apart so that the container 32 can be moved out from the shelf 22 through the opening 26, as shown by FIG. 6. In similar fashion, when it is desired to insert a container 32 into a tubular shelf 22, the container is moved sideways into the front opening 26. The rearwardly directed curved surfaces of the caps 34 contact the edges 28, 30 and cam them apart as the container 32 is moved inwardly through the opening 26. This allows a quick and easy fit of each container 32 into its shelf 22.

As clearly shown by FIG. 3, the radial space in the groove 24 outwardly of the tubular shelf 22 allows expansion room in the grooves 24 for the upper and lower portions of the shelf 22 as they move apart. The grooves 24 are sized such that the containers 32 can be easily moved into and out from the tubular shelf 22 without binding of the end portions of the tubular shelf 22 in the sockets 24. However, the fit is still close enough that the end portions of the tubular shelves 22 are securely held in the grooves 24.

FIGS. 1 and 2 show a rack 10 that includes seven tubular shelves 22. However, the number of tubular shelves 22 that may be used is a variable and can be more or less than seven. Also, in the embodiment shown by FIGS. 1 and 2, the tubular shelves 22 are of a length to receive three containers 32. However, the length of the tubes 32 and the number of containers 32 are also a variable.

The containers 32 may be used to store various articles, the choice of which is not apart of the invention. By way of example, the articles may be nuts, bolts, screws, drill bits, or other small articles that can be found in a work shop. Or, the articles may be buttons, spools of thread, and things of that sort used for sewing. The articles may be fish hooks, weights, lures, etc. Or, they may be paper clips, staples, erasers, and other objects that are found or needed at a desk. These are but a few of examples of an almost endless number of articles that can be placed into containers which are in turn stored in the tubular shelves 22.

Figure 4:
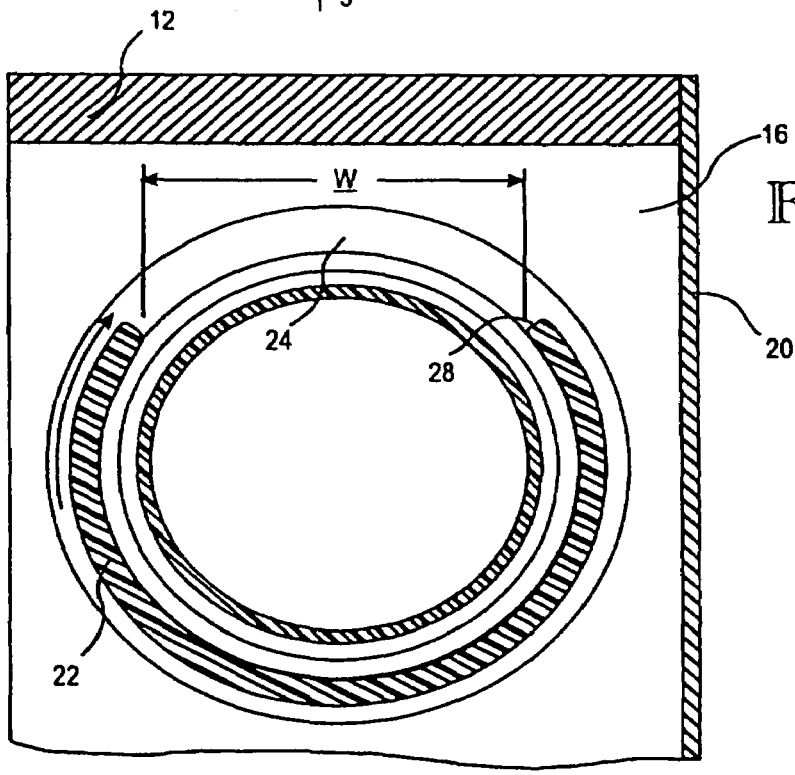
FIG. 4 is a view like FIG. 3 but showing the tubular shelf rotated so that the opening is directed upwardly.

In the embodiment shown by FIGS. 1-3, the shelves 22 may be rotated in place. Accordingly, it may be desirable to place the containers 32 in the shelves 22 and then rotate the opening 26 towards the back 20, so that the contents of the shelves 22 are not seen, or to the top (FIG. 4).

Figure 7:
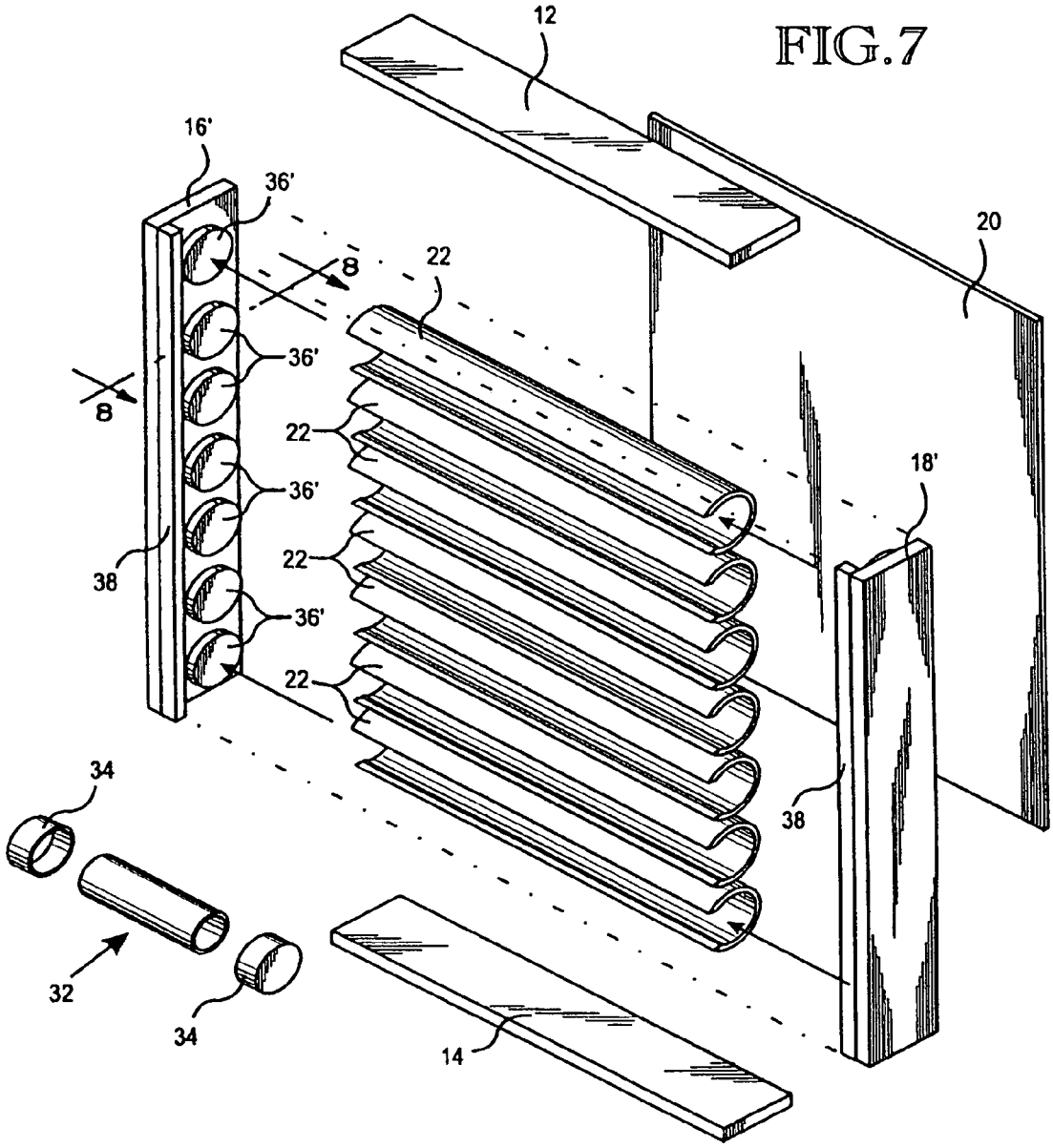
FIG. 7 is a view like FIG. 2 but of a modified form of the rack, such view showing axles on the side walls of the rack which fit into the ends of the tubular shelves.
Figure 8:
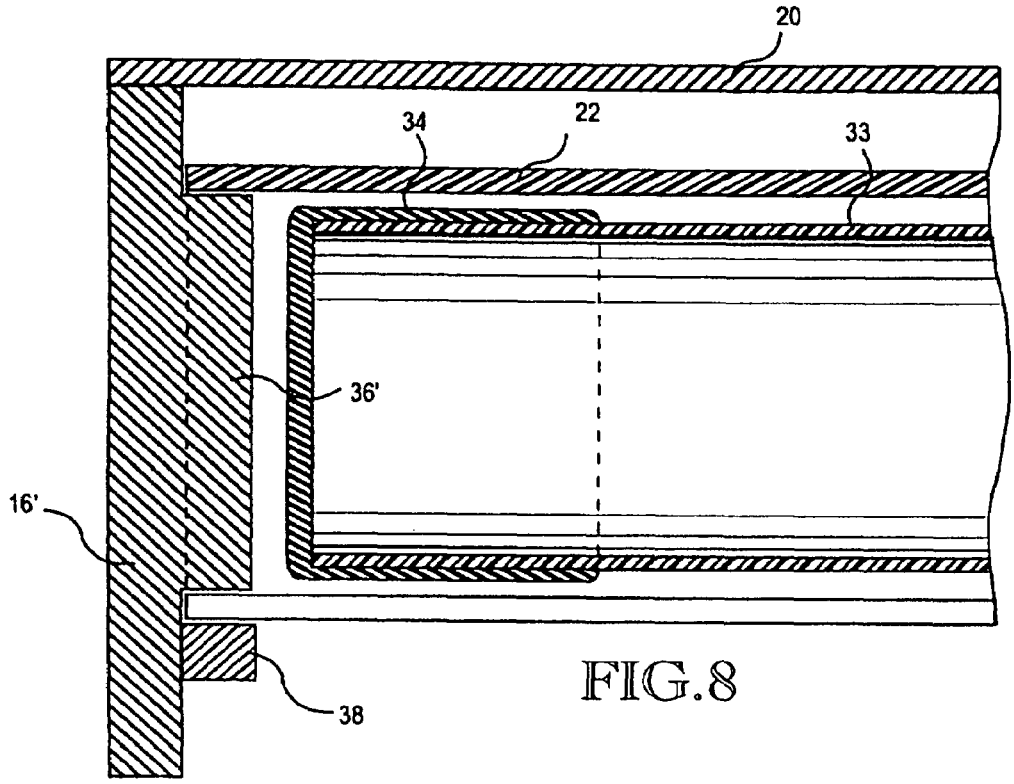
FIG. 8 is a view like FIG. 5 but of the embodiment shown by FIG. 7, such view being taken substantially along line 8-8 of FIG. 7.

The portions of the sides 16, 18 that are inside the annular sockets 24 are in fact axles on which the tubular shelves 22 may rotate. These axles 36 are formed when the grooves 24 are cut into the sides 16, 18. As shown by FIGS. 7 and 8, the sides 16', 18' may be provided with axles 36' that project outwardly from the inner surfaces of the sides 16', 18'. Trim strips 38 may be provided on the side 16', 18' outwardly from the axles 36' this is shown by FIGS. 7 and 8. As shown by FIG. 8, the axles 36' snuggly fit within the ends of the tubular shelves 22. Ample expansion room exists around the axles 36' to allow the spreading of the tubular shelf 22 that happens when the container is moved into or out from the interior of the shelf 22.

It is within the scope of the invention to provide circular sockets in the sides 16, 18 having a diameter substantially equal to the outside diameter of the annular sockets 24. An advantage of the constructions shown by FIGS. 1-8 is that the parts may be sized so that there is frictional contact between the ends of the tubular shelves 22 and the axles 36, 36' to hold the shelves 22 against rotation. This frictional contact will not prevent rotation because the frictional force can be easily overcome by applying a rotational force on the tubular shelves 22. Also, the axles 36, 36' prevent the tubular shelves 22 from rattling in the rack 10 because of the freedom of movement allowed by tubular sockets. However, if this movement is not objectionable, circular sockets in the sides are satisfactory.

Figure 9:
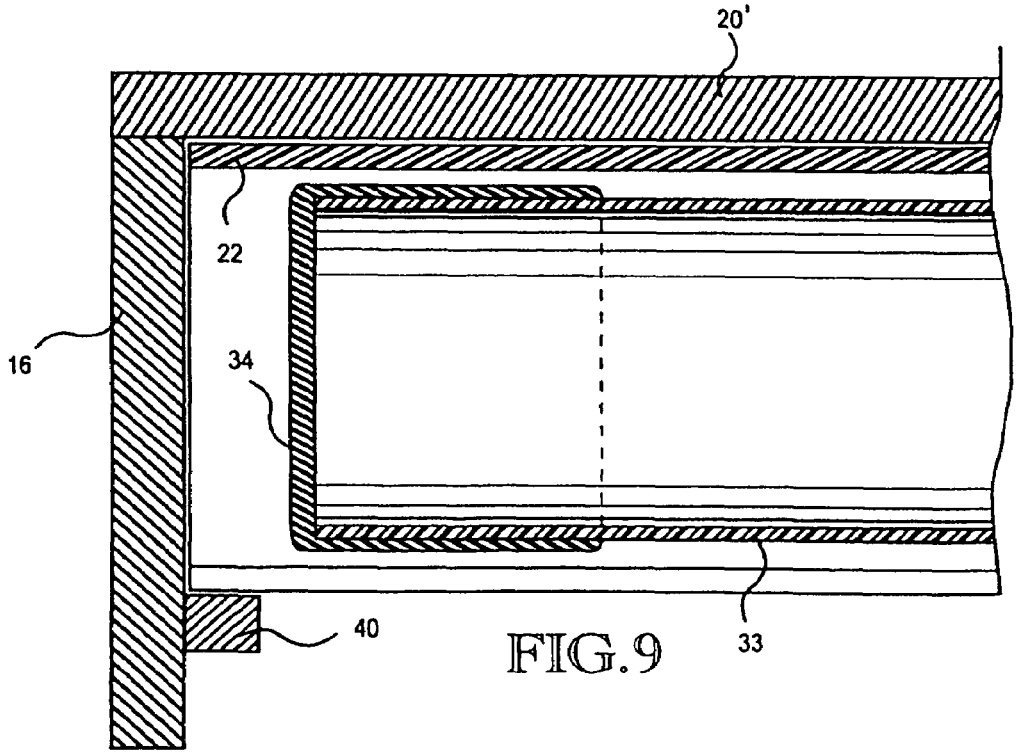
FIG. 9 is a view like FIG. 8 but of a third embodiment in which the bottom tubular shelf lays on the bottom wall and each of the other tubular shelves lays on the tubular shelf below it, and all of the tubular shelves are trapped vertically between the rear wall of the housing and side strips at the front of the housing.
Figure 10:
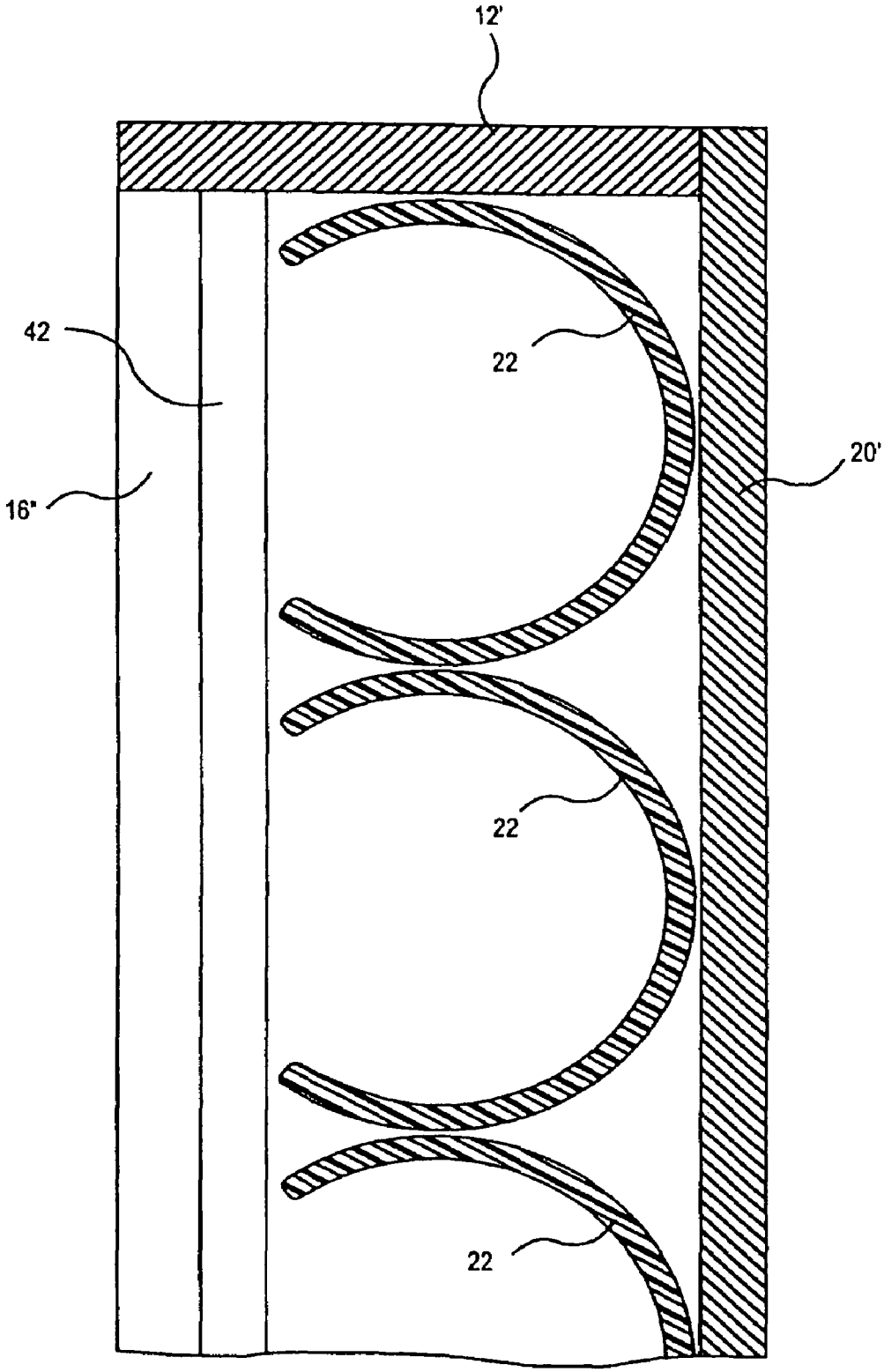
FIG. 10 is a fragmentary vertical sectional view showing two of the tubing shelves resting on the shelf below it and showing the tubular shelves trapped horizontally between the rear wall of the housing and side strips at the front of the house.

FIGS. 9 and 10 disclose an embodiment in which the bottom tubular shelf (not shown) rests on the bottom wall 14 and the tubular shelves 22 above the bottom tubular shelf each sits down on the tubular shelf below it. The tubular shelves have ends that are close to the sidewalls 16, 18. See end 16 in FIG. 9. From front to rear, the tubular shelves 22 are trapped between the rear wall 20 and a pair of side strips, one of which is designated 40. Strip 40 is secured to wall 16. A like strip (not shown) is secured to the sidewall 18 and it extends vertically. The tubular shelves 22 are trapped from front to rear between the rear wall 20' and these strips 40. As shown by FIG. 10, the tubular shelves 32 can spread apart above and below the slot opening. The strips 40 allow only small amount of rotation of the tubular shelves 32. In this embodiment, the slot opening 26 is always at the front of the assembly.

Figure 11:
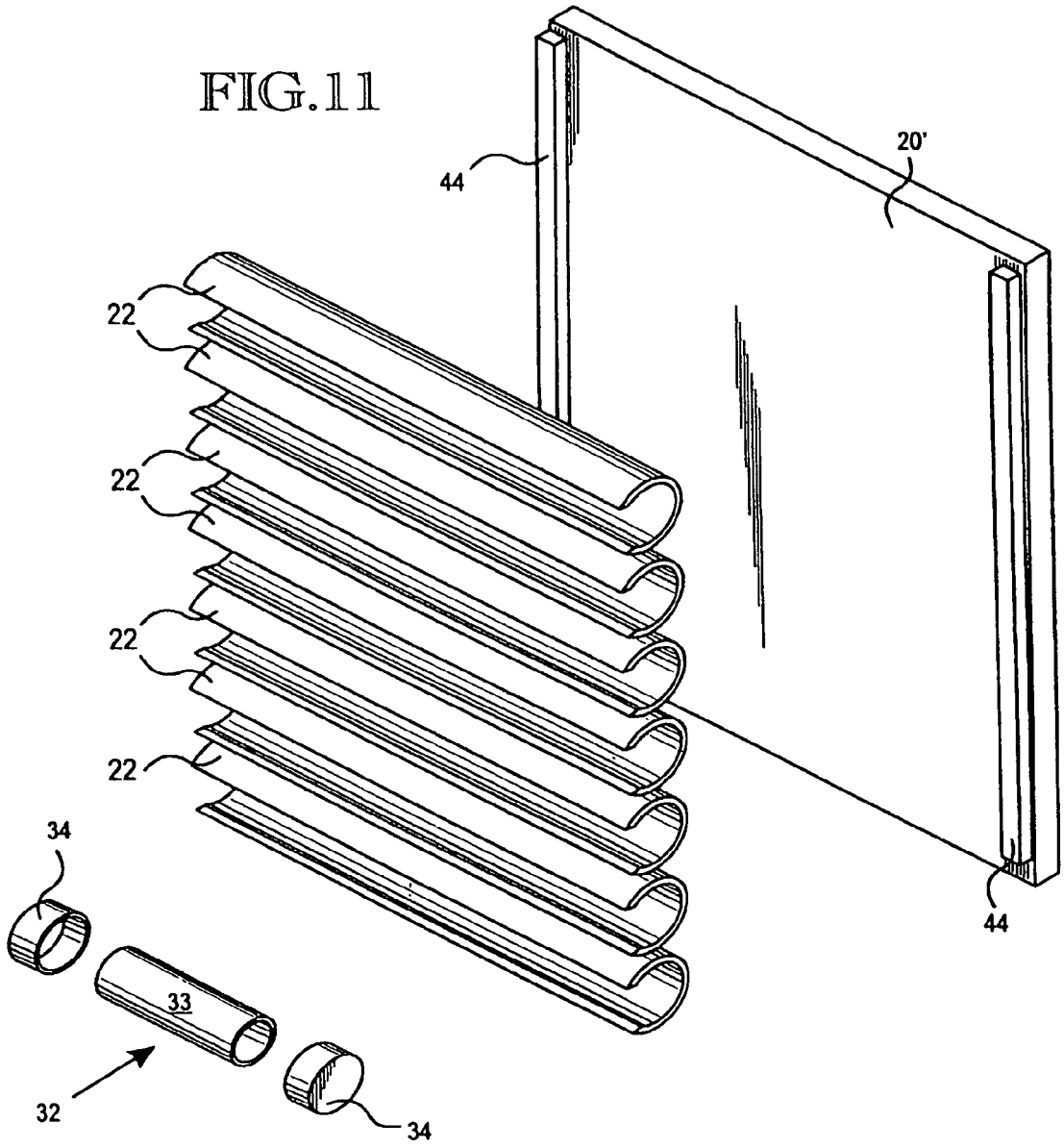
FIG. 11 is an exploded pictorially view like FIGS. 1 and 7, showing an embodiment in which the tubular shelves are attached at their backs to a rear wall.
Figure 12:
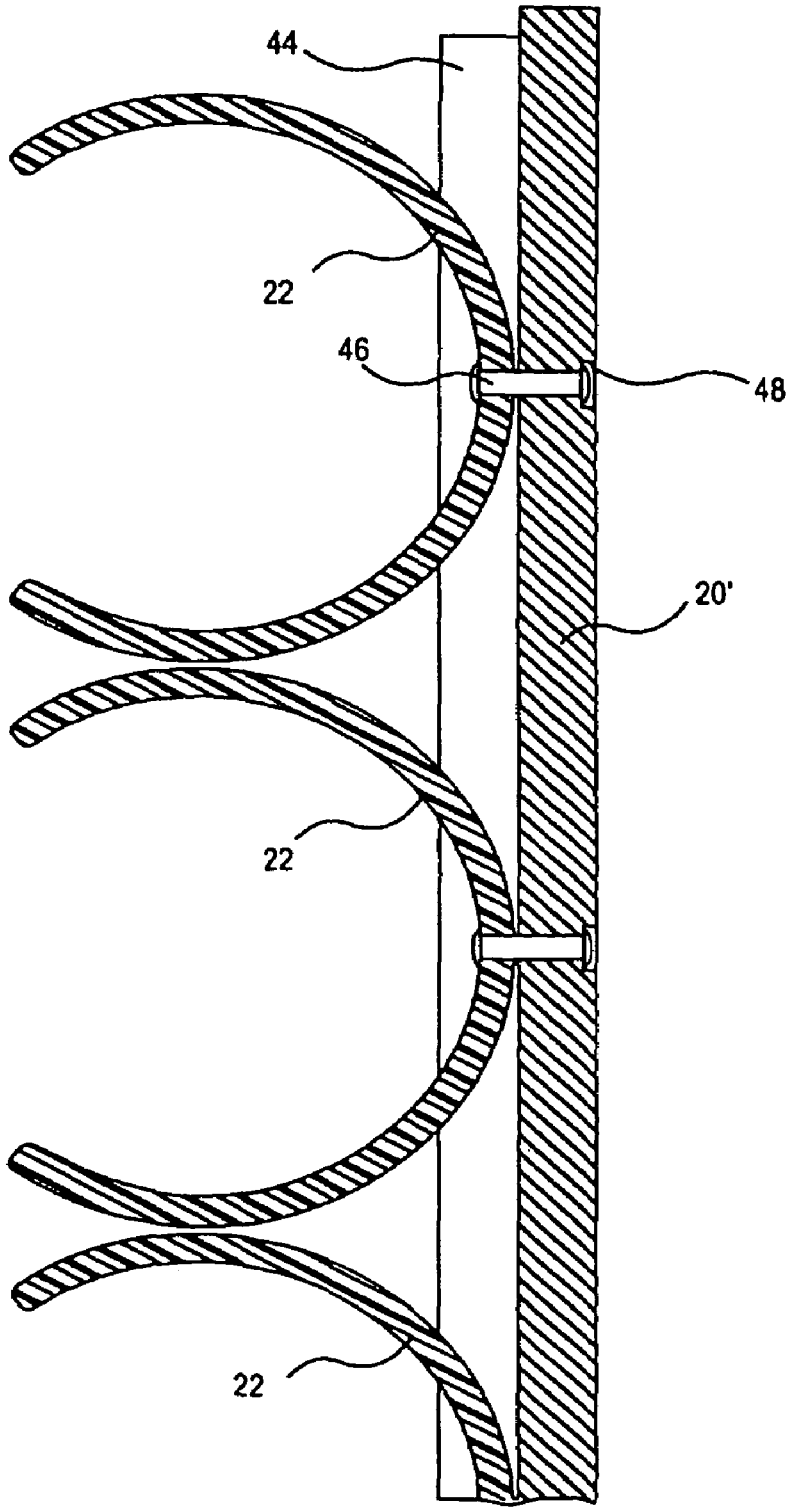
FIG. 12 is a fragmentary vertical sectional showing the two upper tubes and a portion of the third tube in the assembly of FIG. 11, such views showing the storage tubes being connected at their backs to a rear wall.

FIGS. 11 and 12 show an embodiment comprising a plurality of tubular shelves 22 that are connected at their rears to a rear wall or member 20'. Side strips 44, 46 may be secured to the sides of the rear wall such that they are positioned outwardly of the ends of the tubular shelves, allowing them to serve as stops for preventing unwanted endwise movement of the containers 22 out from the ends of the tubular shelves 22. In this embodiment, the character of the rearwall member may vary considerably. It may be a relatively narrow member positioned rearwardly of the center portions of the tubular shelves 22. The center portions of the tubular shelves 22 are connected to this rear member and the opposite end portions of the tubular shelves 22 project laterally outwardly from it. In this embodiment, small bumpers may be provided inside the tubular shelves at the ends of the tubular shelves in place of the strips 44, 46. These bumpers may be fastened to the tubular shelves 22 in any suitable manner, such as by glue or screw fasteners, for example.

The various housing or frame parts can be made from a variety of materials, e.g. wood, plastic, composition materials, metals, etc. The tubular shelves are preferably made from a suitable structural plastic material, such as PVC, but can be made from other plastics and non-plastic materials as well, such as thin-wall metal tubing.

The illustrated embodiments are only examples of the present invention and, therefore, are non-limitive. It is to be understood that many changes in the particular structure, material and features of the invention may be made without departing from the spirit in scope of the invention. Therefore, it is my intention that my patent rights not be limited by the particular embodiments illustrated and described herein, but rather are to be determined by the following claims, interpreted according to accepted doctrines of claim interpretation, including use of the doctrine of equivalents.

What is claimed is:

1. A storage system, comprising:

a frame;

a plurality of elongated tubular members mounted on said frame;

a plurality of containers of a predetermined length and diameter;

each said elongated tubular member having opposite ends and a sidewall including a rear mounting portion and a longitudinal slot extending from one of said ends to the other, substantially diametrically forwardly of the rear mounting portion;

said tubular member having an inside diameter that is larger than the outside diameter of a said container said slot having throughout its length a width that is narrower than the diameter of a said container;

said tubular member being sufficiently resilient that each of said container can be moved sideways against the slot and it will widen the slot a sufficient amount to allow the container to move through the slot into or out from a tubular member; and wherein the frame comprises a vertically extending rear member and the rear mounting portion of the sidewall of the plurality of elongated tubular members are secured to such rear member.

2. The storage system of claim 1, wherein the containers comprise tubular body portions and end caps that are frictionally retained on opposite ends of the tubular body portions, said end caps having an outside diameter that is smaller than the inside diameter of the tubular member and is larger than the width of the slot.

3. The storage system of claim 2, wherein the tubular members extend horizontally, said system further comprising stops at the ends of the elongated tubular members for preventing the containers from sliding lengthwise outwardly from the ends of the elongated tubular members.

4. The storage system of claim 1, wherein the tubular members extend horizontally, said system further comprising stops at the ends of the elongated tubular members for preventing the containers from sliding lengthwise outwardly from the ends of the elongated tubular members.

* * * * *